US006193127B1

(12) United States Patent
Huang

(10) Patent No.: US 6,193,127 B1
(45) Date of Patent: Feb. 27, 2001

(54) AIR-TIGHT STRUCTURE BETWEEN A TOP CAP AND A BODY OF A PNEUMATIC TOOL

(75) Inventor: Chen-Fa Huang, Ta Li (TW)

(73) Assignee: Besco Pneumatic Corp., Ta Li (TW)

( * ) Notice: Subject to any disclaimer, the term of this patent is extended or adjusted under 35 U.S.C. 154(b) by 0 days.

(21) Appl. No.: 09/500,961

(22) Filed: Feb. 15, 2000

(51) Int. Cl.[7] ..... B25C 1/04
(52) U.S. Cl. ..... 227/130
(58) Field of Search ..... 173/130, 10; 91/220

(56) References Cited

U.S. PATENT DOCUMENTS 265,618 * 10/1882 McKay et al. ..... 227/130
2,821,170 * 1/1958 Jacobus ..... 227/130
3,434,643 * 3/1969 Wandel ..... 227/130
3,438,449 * 4/1969 Smith ..... 227/130
3,813,993 * 6/1974 Smith ..... 91/220
4,215,808 * 8/1980 Sollberger et al. ..... 227/130
4,573,623 * 3/1986 Sexton, Jr. et al. ..... 227/130

* cited by examiner

*Primary Examiner*—Scott A. Smith
(74) *Attorney, Agent, or Firm*—Bacon & Thomas, PLLC

(57) ABSTRACT

An air-tight structure of a pneumatic tool includes a top cap having a plurality of threaded holes defined in a bottom thereof. A tool body is connected to the top cap and has a shaft removably received therein. A plurality of passages are defined through the tool body and located in alignment with the threaded holes so that a plurality of bolts extend through the passages and are threadedly engaged with the threaded holes in the top cap. A groove is defined in a top of the tool body and a seal is received in the groove.

1 Claim, 3 Drawing Sheets

AIR-TIGHT STRUCTURE BETWEEN A TOP CAP AND A BODY OF A PNEUMATIC TOOL

BACKGROUND OF THE INVENTION

1. Field of the Invention

The present invention relates to an air-tight structure between a top cap and a body of a pneumatic tool.

2. Description of the Related Art

A conventional pneumatic tool is shown in FIG. 1 and generally includes a top cap 10 and a tool body 11 which includes a movable shaft 110 retractably received in a tubular part of the tool body 11. The removable shaft 110 is actuated by pneumatic power. An air-tight structure is employed to obtain an air sealing feature between the top cap 10 and the tool body 11. The air-tight structure includes a metal plate 16 located between the top cap 10 and the tool body 11, a rubber seal 15 is engaged with the metal plate 16 so as to seal the abutting surface between the top cap 10 and the tool body 11. The rubber seal 15 tends to be scraped and broken when connecting the top cap 10 and the tool body 11. The metal plate 16 is easily deformed and air leakage between the top cap 10 and the tool body 11 can result. Although the rubber seal 15 is replaced by a PU seal in some pneumatic tools, the PU-made seal is fitted into the top cap 10 by a large force which might affect the combination of the parts of the tool. Besides, the top cap 10 is fixedly connected to the tool body 11 by extending bolts from a top of the top cap 10 and engaged with the tool body 11. Therefore, there are a plurality of sink holes defined in the top of the top cap and the sink holes make the user's hands uncomfortable.

SUMMARY OF THE INVENTION

The present invention intends to provide an air-tight structure between a top cap and a body of a pneumatic tool, wherein the tool body has a groove defined in a top thereof and a seal is engaged with the groove. The top cap is fixedly connected to the tool body by extending bolts through the tool body from a bottom of the tool body and is threadedly connected to the top cap so that the top cap has a smooth top surface.

In accordance with one aspect of the present invention, there is provided an air-tight structure of a pneumatic tool comprising a top cap connected to a body tool in which a shaft is removably received. A plurality of threaded holes are defined in a bottom of the top cap. A plurality of passages are defined through the tool body and located in alignment with the threaded holes so that a plurality of bolts extend through the passages and are threadedly engaged with the threaded holes in the top cap. A groove is defined in a top of the tool body and a seal is received in the groove.

The object of the present invention is to provide a pneumatic tool that includes a tool body having a groove defined in a top thereof for receiving a seal therein, and a top cap which is connected to the top of the body. Bolts extend through the tool body and are threadedly engaged with the top cap so that the top surface of the top cap has no sink holes.

These and further objects, features and advantages of the present invention will be shown in the following description when taken in connection with the accompanying drawings show, for purposes of illustration only, several embodiments in accordance with the present invention.

DETAILED DESCRIPTION OF THE PREFERRED EMBODIMENT

Figure 4:
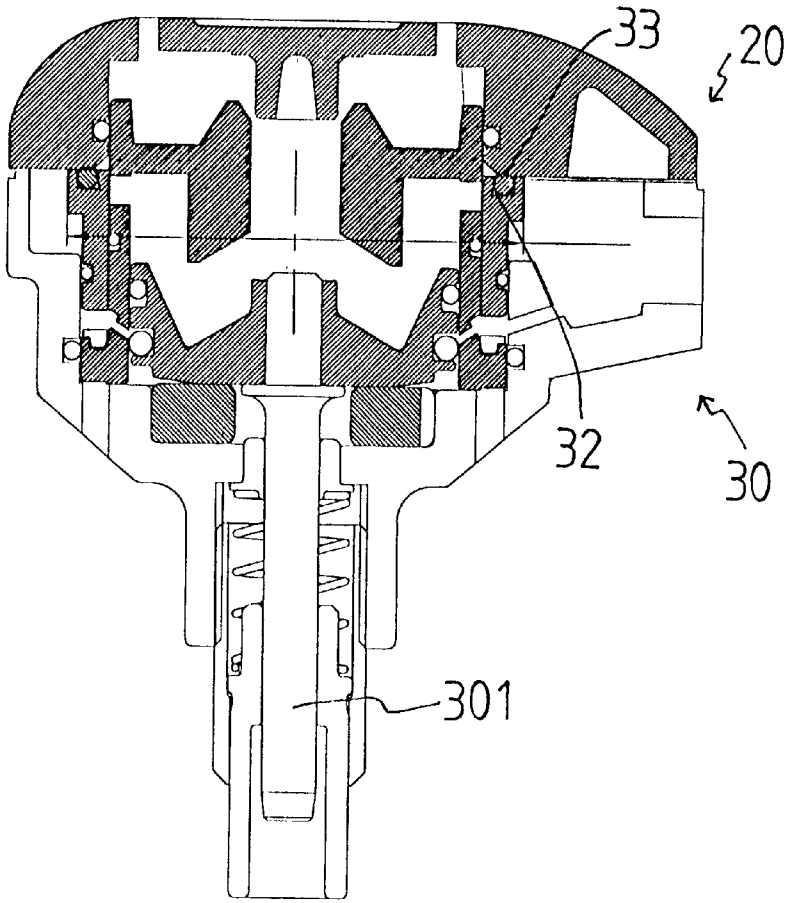
FIG. 4 is a side elevational view, partly in section, of the pneumatic tool of the present invention.
Figure 1:
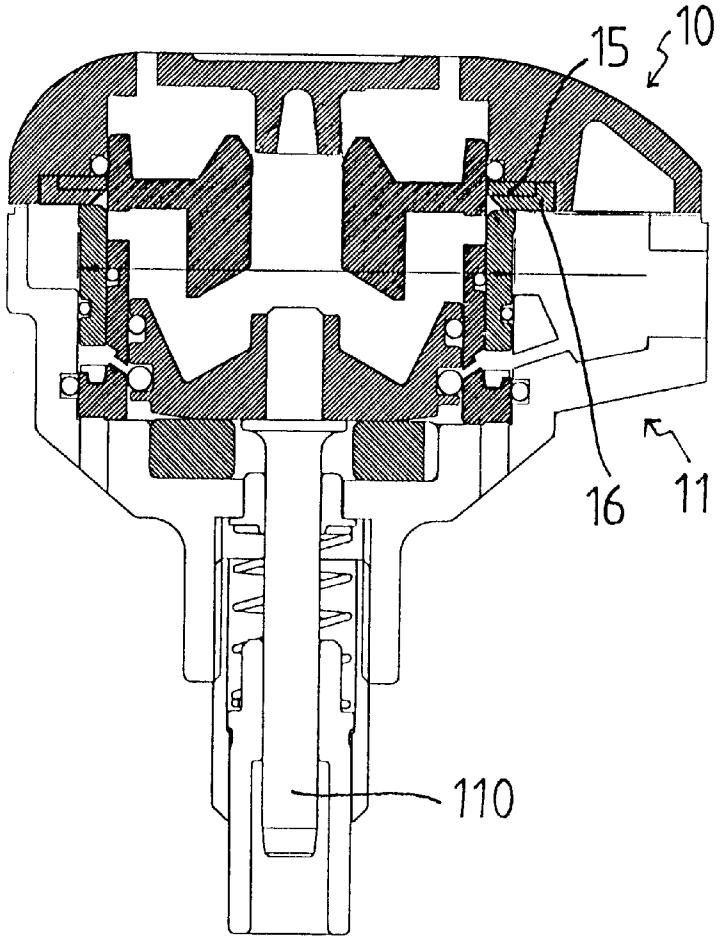
FIG. 1 PRIOR ART
FIG. 1 is a side elevational view, partly in section, of a conventional pneumatic tool.
Figure 2:
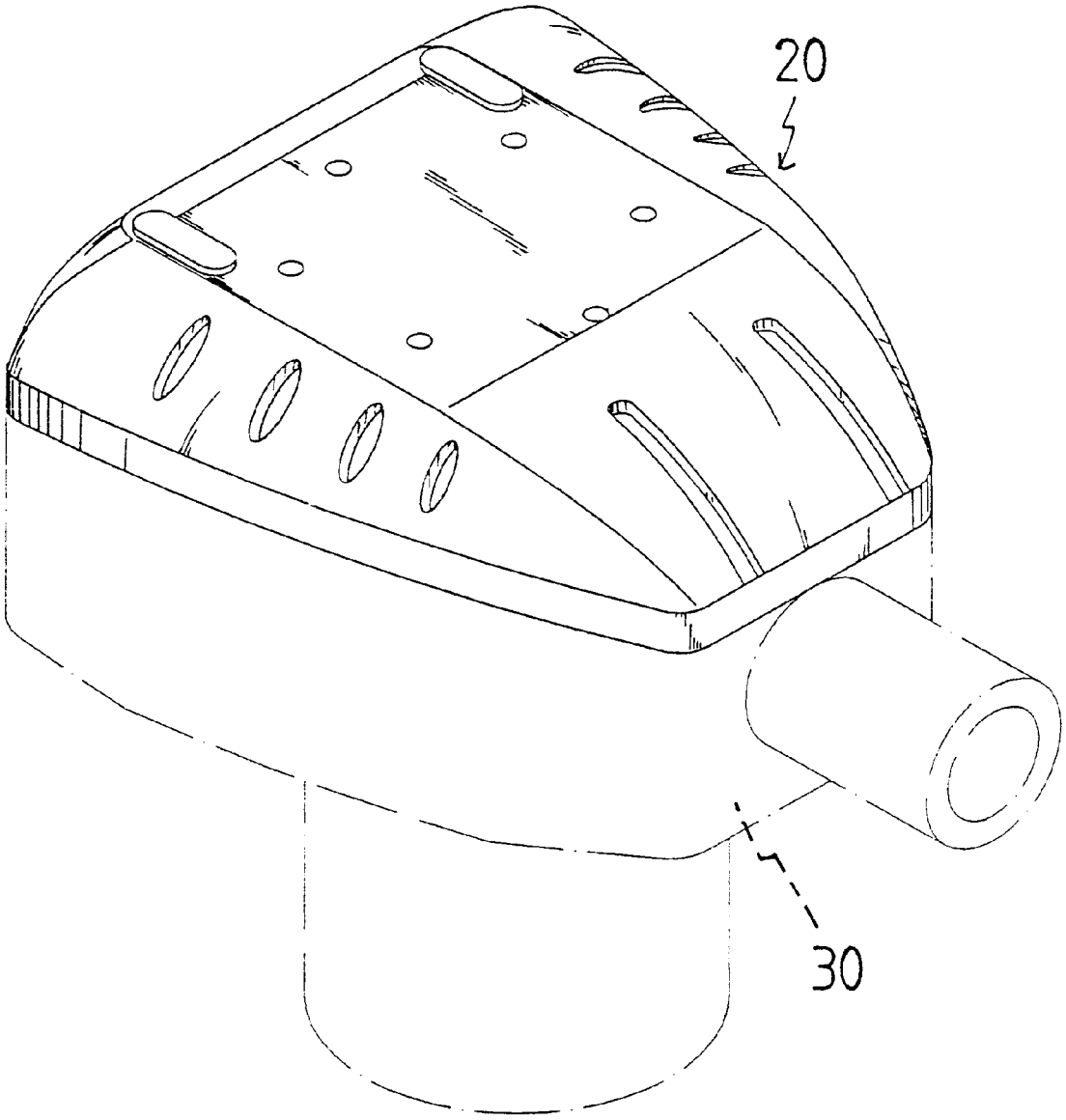
FIG. 2 is a perspective view to show a pneumatic tool in accordance with the present invention.
Figure 3:
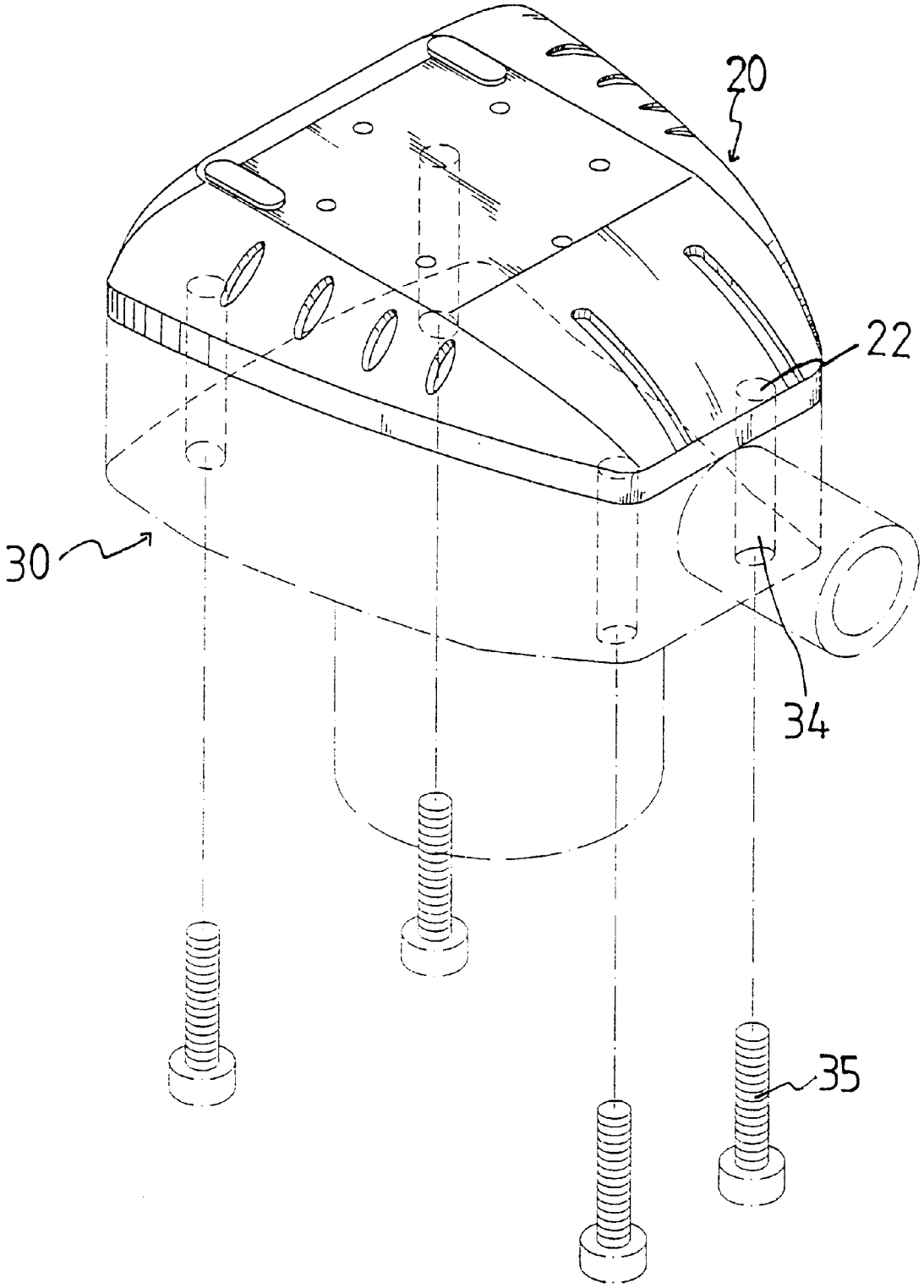
FIG. 3 is an exploded view to show four bolts and the pneumatic tool of the present invention.

Referring to FIGS. 2 to 4, the pneumatic tool in accordance with the present invention comprises a top cap 20 having a plurality of threaded bores 22 defined in a bottom thereof. A tool body 30 is connected to the bottom of the tool body 20 and includes a shaft 301 removably received in the tool body 30. The shaft 301 is actuated by pneumatic power as known in the art. A plurality of passages 34 are defined through the tool body 30 and located in alignment with the threaded bores 22 in the top cap 20 so that a plurality of bolts 35 extend through the passages 34 and are threadedly engaged with the threaded bores 22 in the top surface cap 20. A groove 32 is defined in a top of the tool body 30 and a seal element 33 is received in the groove 32. When the bolts 35, the top cap 20 and the tool body 30 are firmly connected with each other the seal element 33 effectively seals the abutting surface between the top cap 20 and the tool body 30.

It is to be noted that because the bolts 35 extend from the bottom of the tool body 30 and are connected to the top cap 20 it will be not necessary to make sink holes on the top surface of the top cap.

While we have shown and described various embodiments in accordance with the present invention, it should be clear to those skilled in the art that further embodiments may be made without departing from the scope and spirit of the present invention.

What is claimed is:

1. An air-tight structure for a pneumatic tool, comprising:

a top cap including upper and lower surfaces;

a plurality of threaded bores extending from a lower surface of the top cap toward the upper surface of the top cap without breaking the upper surface of the top cap;

a tool body including upper and lower surfaces;

a groove on the upper surface of the tool body;

a shaft removably received in the tool body;

a plurality of passages extending between the upper and lower surfaces of the tool body, each of the passages in axial alignment with a corresponding one of the threaded bores of the top cap;

a sealing element received on the groove; and a plurality of bolts each having a bolt head and a threaded section, the threaded section of each of the bolts extending from the lower surface of the tool body through the tool body via one of the respective passages of the tool body and threadedly engaged with a corresponding one of the threaded bores of the top cap, to firmly connect the tool body to the top cap with the seal element effectively forming a seal between the top cap and the tool body, whereby the bolt heads will be shielded by the tool body.

* * * * *